US007357668B2

(12) United States Patent
Wan et al.

(10) Patent No.: US 7,357,668 B2
(45) Date of Patent: Apr. 15, 2008

(54) UNIVERSAL SERIAL BUS ELECTRICAL CONNECTOR WITH OVER-CURRENT PROTECTION DEVICE

(75) Inventors: Feng Wan, Kunshan (CN); Jin-Kui Hu, Kunshan (CN); Guo-Hua Zhang, Kunshan (CN)

(73) Assignee: Hon Hai Precision Ind. Co., Ltd., Taipei, Hsien (TW)

( * ) Notice: Subject to any disclaimer, the term of this patent is extended or adjusted under 35 U.S.C. 154(b) by 0 days.

(21) Appl. No.: 11/528,153

(22) Filed: Sep. 27, 2006

(65) Prior Publication Data

US 2007/0077816 A1 Apr. 5, 2007

(30) Foreign Application Priority Data

Sep. 30, 2005 (CN) ..... 2005 2 0076112 U

(51) Int. Cl.
*H01R 13/66* (2006.01)

(52) U.S. Cl. ..... 439/541.5; 439/620.6

(58) Field of Classification Search ..... 439/698, 439/874, 541.5, 620.6
See application file for complete search history.

(56) References Cited

U.S. PATENT DOCUMENTS

| | | | | |
|---|---|---|---|---|
| 6,217,389 | B1 * | 4/2001 | Jatou | 439/620.29 |
| 6,547,597 | B2 * | 4/2003 | Harris, IV | 439/620.22 |
| 2002/0042223 | A1 * | 4/2002 | Belopolsky et al. | 439/541.5 |
| 2004/0029444 | A1 * | 2/2004 | Tang | 439/607 |

* cited by examiner

*Primary Examiner*—Tho D. Ta
*Assistant Examiner*—Travis Chambers
(74) *Attorney, Agent, or Firm*—Wei Te Chung

(57) ABSTRACT

A Universal Serial Bus electrical connector comprises an insulative housing forming at least two plug receiving areas, a plurality of signal contacts, and at least two power contacts. The signal contacts and the power contacts extend into the plug receiving areas. A printed circuit board is integrated into the insulative housing with at least two over-current protection devices mounted thereon. Each over-current protection devices is corresponding to a plug receiving area and electrically connected with a power contact extending into the corresponding plug receiving area through the printed circuit board.

17 Claims, 5 Drawing Sheets

UNIVERSAL SERIAL BUS ELECTRICAL CONNECTOR WITH OVER-CURRENT PROTECTION DEVICE

BACKGROUND OF THE INVENTION

1. Field of the Invention

The present invention generally relates to an electrical connector, and more particularly to a Universal Serial Bus (USB) electrical connector with a built-in over-current protection device such as a fuse.

2. Description of Related Art

The Universal Serial Bus electrical connector is well known in the art and designed to replace all the various input/output interfaces current used on the personal computers, providing a single interface for all peripherals. The Universal Serial Bus specifications support hot pluggability, permit peripherals to be connected and disconnected to a computer system without having to shut down the system, and include such features as polarization and power contact positions. In addition, the specifications call for a fuse on the interface card to protect the system from over-currents.

Placement of a fuse on the interface card fulfills the need for system protection, but makes the fuse difficult to access. The present invention seeks to provide a Universal Serial Bus interface in which the over-current protection device is integrated into the electrical connector rather than provided on the interface card. One proposal is to include a printed circuit board within the electrical connector, and soldering over-current protection device thereto. The other is to integrate the over-current protection device such as a fuse into the housing of the electrical connector directly without applying the printed circuit board thereto. However, to the latter proposal, it is not a practical manner to manufacture. First, it complicates the design of the housing for receiving the over-current protection device and the electrical contacts simultaneously. Second, it is difficult to establish reliable mechanical and electrical connection between the over-current protection device and the corresponding power contacts of the electrical connector. Third, it is also difficult to find proper type of over-current protection device such as a fuse in the market to locate between a mating end for mating with a mating plug and a mounting end for mounting to a motherboard of the power contact.

Hence, an improved electrical connector is desired to overcome the problems mentioned above.

BRIEF SUMMARY OF THE INVENTION

Accordingly, an object of the present invention is to provide an electrical connector, such as a Universal Serial Bus electrical connector, having a over-current protection device, which has reliable performance and is easily assembled.

In order to achieve the above-mentioned object, an electrical connector comprises an insulative housing, a plurality of electrical contacts received in the insulative housing, and a printed circuit board. Each electrical contact comprises a mating end and a mounting tail. The insulative housing defines a plug receiving area with the electrical contacts extending therein. The printed circuit board is attached to the insulative housing and has an over-current protection device thereto. One of electrical contacts comprises a mating part extending into the receiving areas and a mounting part extending out of the insulative housing. The printed circuit board and the over-current protection device connect the mating part and the mounting part.

In order to achieve the above-mentioned object, a Universal Serial Bus electrical connector comprises an insulative housing forming at least two plug receiving areas, a plurality of signal contacts, at least two power contacts, and a printed circuit board. The signal contacts and the power contacts extend into the plug receiving areas. The printed circuit board is attached to the insulative housing with at least two electrical devices thereon. Each plug receiving area is corresponding to an electrical device. The power contacts extend into the plug receiving areas and electrical connected with the electrical devices through the printed circuit board.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
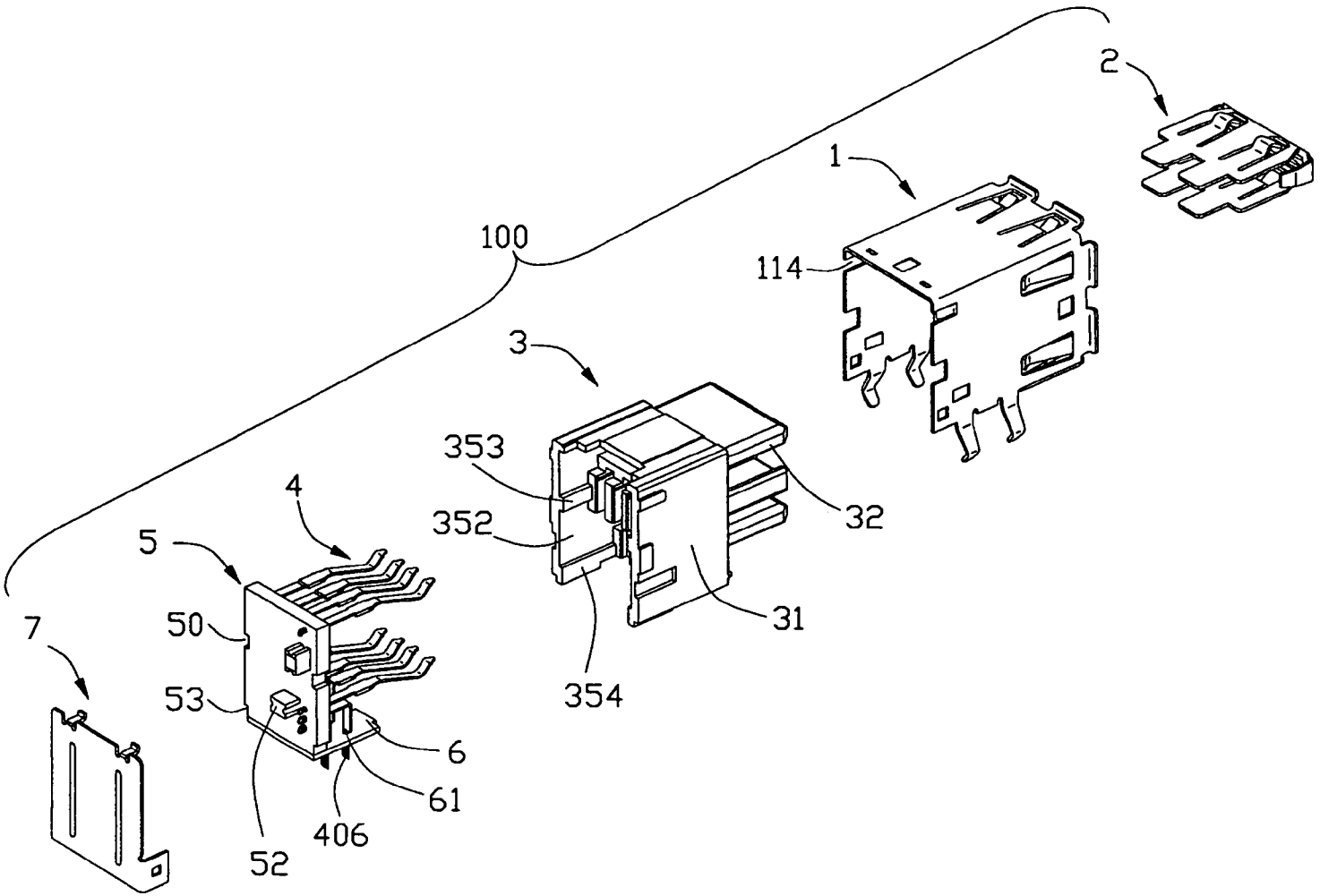
FIG. 1 is an exploded view of an electrical connector in accordance with the present invention.
Figure 2:
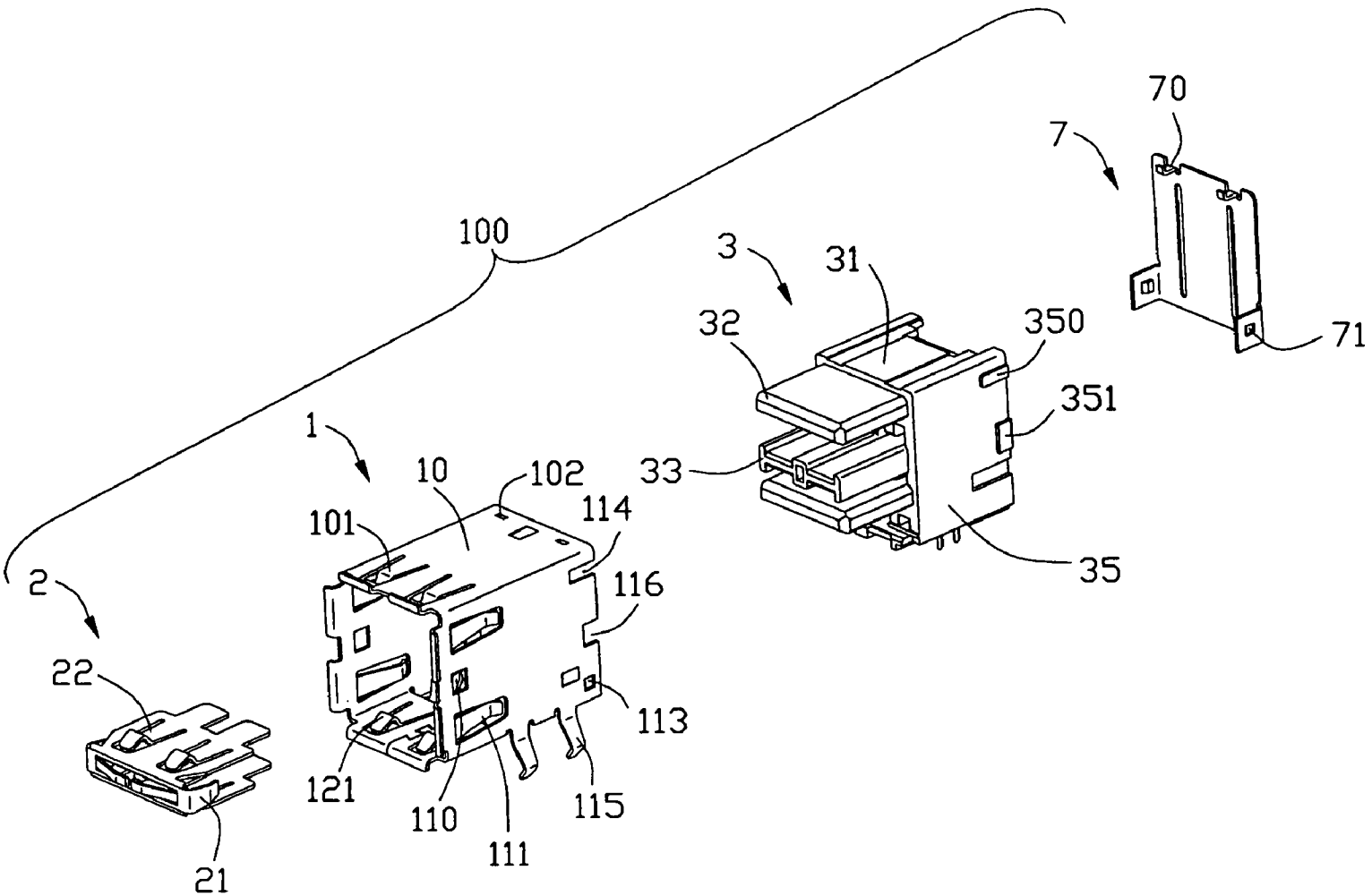
FIG. 2 is another exploded view of the electrical connector of FIG. 1, with the printed circuit board attached to the insulative housing.

Reference will now be made to the drawing figures to describe the present invention in detail.

Referring to FIGS. 1-5, a Universal Serial Bus electrical connector 100 in accordance with the present invention, which is mounted to a motherboard (not shown) and adapted for mating with a Universal Serial Bus plug (not shown), comprises a front shell 1, an insulative housing 3, a plurality of electrical contacts 4 received in the insulative housing 3, a printed circuit board 5, and a rear shell 7.

The insulative housing 3 includes a main body 31 and a pair of mating portion 32 extending therefrom. The insulative housing 3 defines a pair of vertical arranged plug receiving areas 34 with the mating portion 32 extending therein. The mating portions 32 respectively support a row of four electrical contacts 4 so that the electrical contacts 4 extend into the plug receiving areas 33. The insulative housing also includes a portion 33 that extends into the space between the pair of mating portions 32, and which supports an internal shielding member 2 from which extend ground tabs 81 for engaging corresponding outer shield of the mating plug. The main body 31 defines a rear receiving space 352 extending in an up to down direction for receiving the printed circuit board 5 and the electrical contacts 4 therein.

Extensions 350, 351 of the insulative housing 3 engages with the recesses 114, 116 of the front shell 1 to secure the front shell 3 to the insulative housing 3. The front shell 1 includes inwardly extending upper and lower ground tabs 101, 121 and side tabs 111. The rear shell 7 is secured to the front shell 1 by the tabs 71 engaging with the openings 113 and fingers 70 engaging with the openings 102. The inner shell 2 is positioned to the front shell 1 by the spring tabs 23 mating with the openings 110. The board locks 115 of the front shell 1 provide grounding to the motherboard.

In addition, internal details of the electrical connector, including the configuration of the mating portion and manner of contact mounting, may be varied without affecting the overall compatibility and performance of the connector. As alternative configurations, the insulative housing can be separate, and the plug receiving areas can be arranged side by side. Those skilled in the art will appreciate that the present invention is applicable to all such versions of the Universal Serial Bus socket connector, as well as to similar data bus connectors.

The electrical contacts 4 of the electrical connector 100 include two power contacts 41 and a plurality of non-power contacts 42, and divided into two mating ports corresponding to the two plug receiving areas 34. The non-power contacts 42 include signal contacts and ground contacts. Each of the electrical contacts 4 includes a horizontal mating end 401 supported by the mating portion 32 and a vertical mounting tail 402 for soldering to the motherboard. The non-power contacts 42 of the electrical connector 100 have the general configuration of the contacts of a general Universal Serial Bus connector. Each power contact 41 includes two separate parts, a mating part and a mounting part. The mating part includes a front end 403 as the mating end and a rear end 404. The mounting part includes a bottom end as the mounting tail 406 and a connect end 405.

The printed circuit board 5 is received in the rear receiving space 352 of the main body 31 with two over-current protection devices 52 mounted thereon. The two over-current protection devices 52 are correspond to the pair of plug receiving areas 34 so that each mating port has a protection device. The rear end 404 and the connect end 405 of each power contact 41 are all mounted to the printed circuit board 5 thereby to electrically connect with the corresponding over-current protection device 35. The mating ends and the mounting tails of the power contacts 41 and the non-power contacts 42 are on one side of the printed circuit board 5, and the protection devices 52 are on the other side of the printed circuit board 5

When the electrical connector 100 works, the electrical current passes the mating part, the printed circuit board 5, the protection device 52, the printed circuit board 5, and the mounting part alternately. The over-current protection device 52 electrically connected the two parts of the power contact 41 by the printed circuit board 5 to protect the computer system from over-currents. The protection devices 52 are in the form of fuses or other over-current devices having electrodes. The main body 31 including two pair of blocks 353, 354 engaging with the recesses 50, 53 defined on the printed circuit board 5 to secure the circuit board 5 in the insulative housing 3. The electrical connector 100 further includes a spacer 6, which defines two rows of passageways 61 therein to provide the mount ends 402 of the electrical contacts 4 extending therethrough. The two parts of the power contacts 41 and the over-current protection devices 52 are soldered to the printed circuit board 5 so that they have accurate positions relate to the printed circuit board to providing reliable electrical connection therebetween. In addition, the power contacts 41 and the printed circuit board 5 having over-current protection devices 52 thereon can mount to the insulative housing 3 as a whole, which simplify the assembling process.

Figure 3:
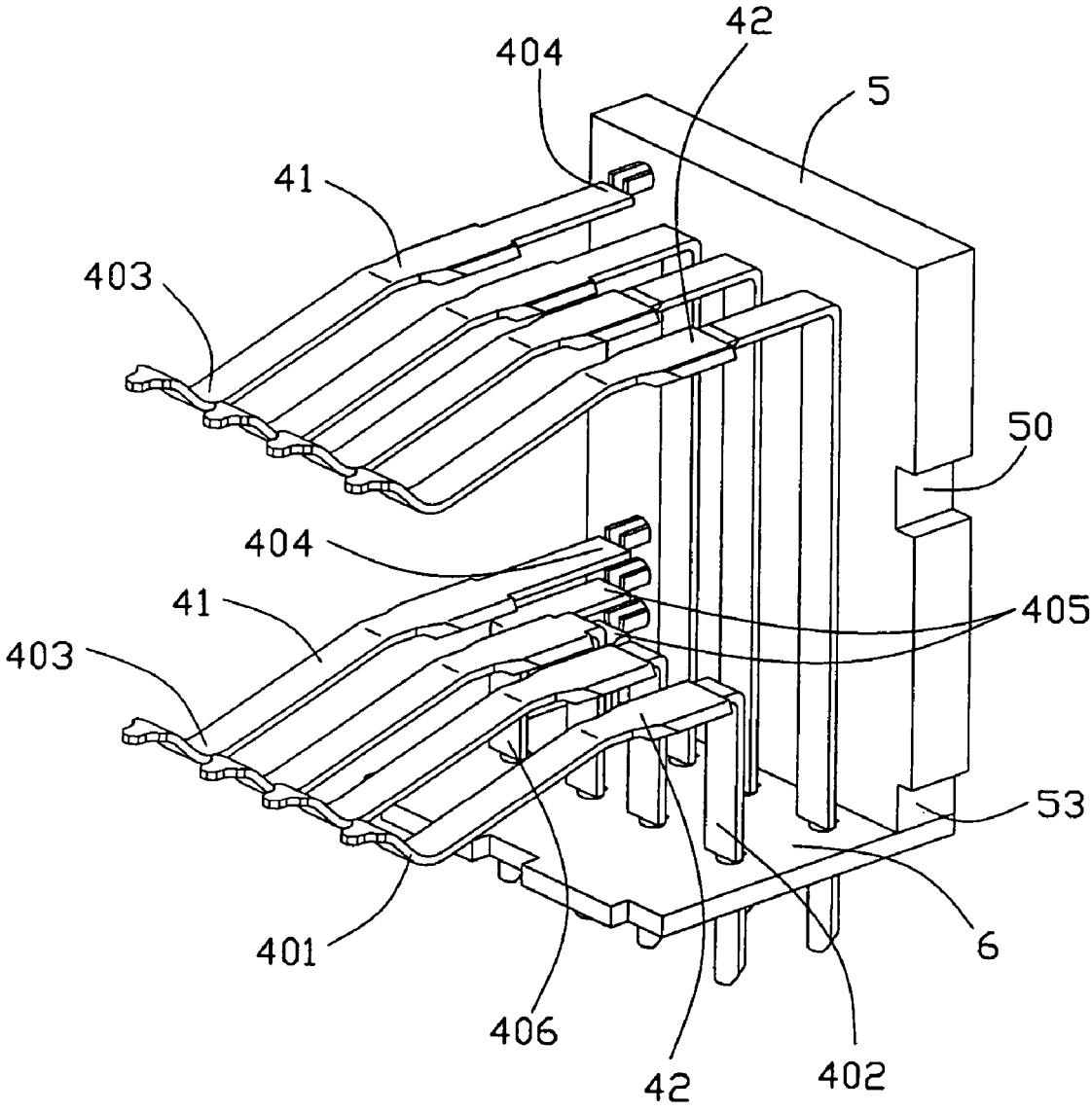
FIG. 3 is a perspective view of the printed circuit board and the electrical contacts of the electrical connector of FIG. 1.
Figure 4:
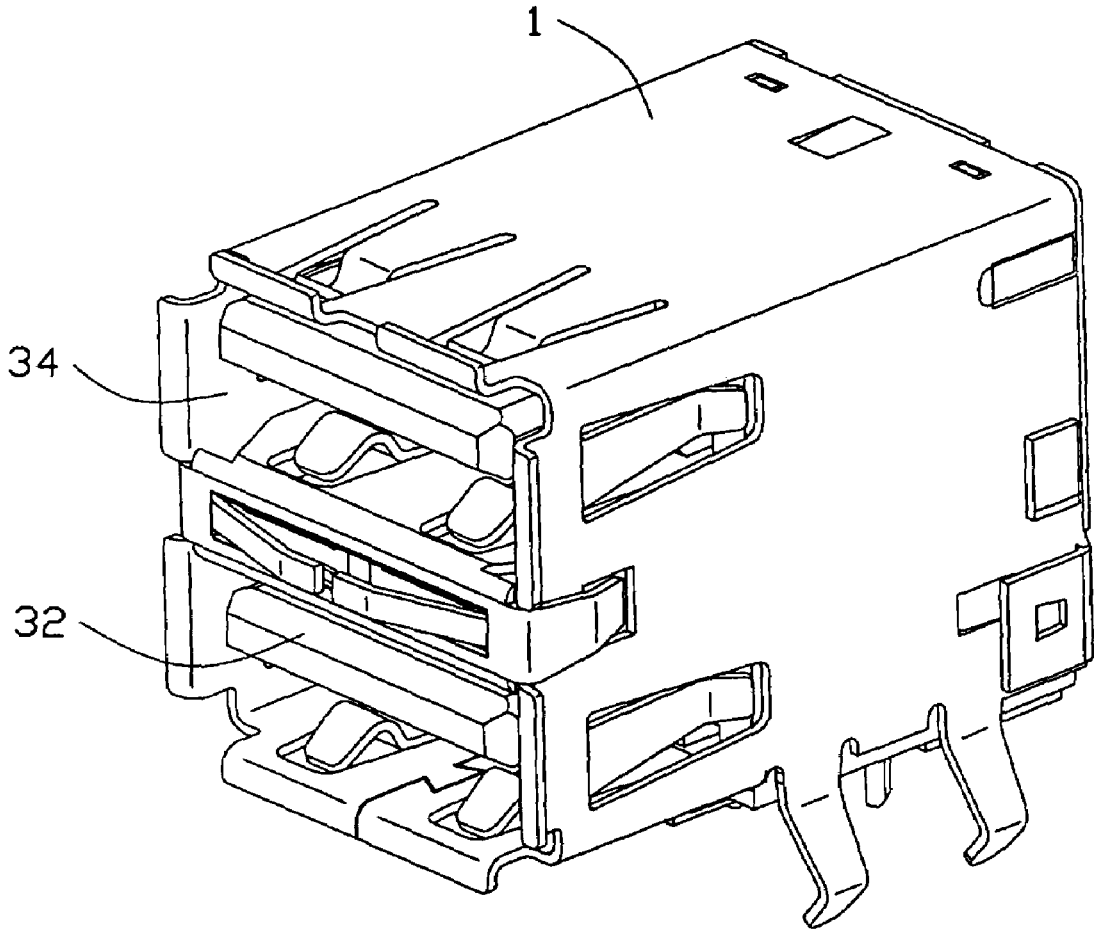
FIG. 4 is a perspective view of the electrical connector of FIG. 1.
Figure 5:
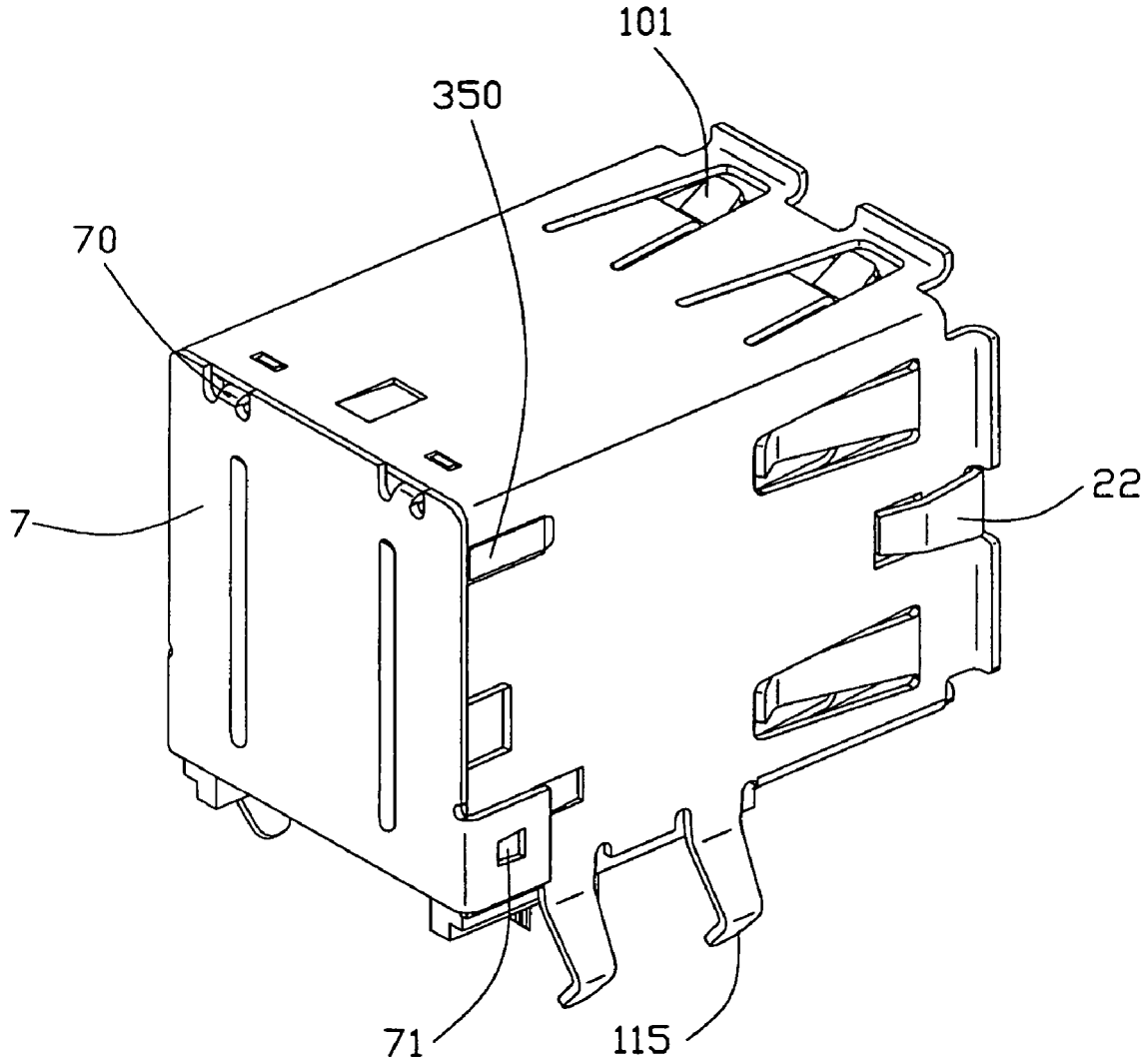
FIG. 5 is a view similar to the FIG. 4, but viewed from a different angle.

As is apparent from FIG. 3, each fuse is electrically connected with only one of the contacts, and in particular with one of the power contacts, but it is within the scope of the invention to electrically connect the fuse or other electrical device with any, some or all of the non-power contacts. Those skilled in the art will also appreciate that although the protection device mounting structure of the invention, as indicated above, has been illustrated in the context of a dual plug Universal Serial Bus connector, the principles of the invention apply equally to single plug Universal Serial Bus connectors having only a single mating portion structure and a single row of contacts, or a pair of contacts on each side of the single mating portion structure.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a plurality of electrical contacts each comprising a mating end and a mounting tail;

an insulative housing receiving the electrical contacts therein and defining a plug receiving area, the electrical contacts extending into the receiving area; and a printed circuit board attached to the insulative housing including an over-current protection device thereon, at least one electrical contact comprising a mating part extending into the receiving areas and a mounting part extending out of the insulative housing, and the mating part and the mounting part connecting with the printed circuit board, respectively, to establish electrical connection with the over-current protection device wherein the mating ends and the mounting tails of the electrical contacts are by one side of the printed circuit board;

wherein the over-current protection device is on the other side of the printed circuit board.

2. The electrical connector as claimed in claim 1, wherein said over-current protection device is a fuse.

3. The electrical connector as claimed in claim 1, wherein the electrical contacts include a power contact and a plurality of non-power contacts, and the power contact is electrically connected with the over-current protection device.

4. A Universal Serial Bus electrical connector, comprising:

an insulative housing forming at least two plug receiving areas;

a plurality of non-power contacts received in the insulative housing and extending horizontally into the plug receiving areas;

at least two power contacts received in the insulative housing, and each plug receiving area having a poyer contact extends thereinto, the non-power contacts and the power contacts being terminated to a motherboard on which the electrical connector positioned; and a vertical printed circuit board received in a rear receiving space of the insulative housing with electrical devices mounted thereon, the electrical devices being corresponding to the plug receiving areas and electrical connected with the power contacts in the corresponding plug receiving areas through the printed circuit board.

5. The Universal Serial Bus electrical connector as claimed in claim 4, wherein each power contact comprises a mating pan extending into the plug receiving area and a mounting part mounted to the motherboard, and wherein the mating part and the mounting part are connected with the primed circuit board, respectively, to establish electrical connection with the electrical device.

6. The Universal Serial Bus electrical connector as claimed in claim 4, wherein the electrical device is an over-current protection device.

7. The Universal Serial Bus electrical connector as claimed in claim 6, wherein the over-current protection device is a fuse.

8. The Universal Serial Bus electrical connector as claimed in claim 4, wherein the non-power contacts are separated from the printed circuit board and on one side of the printed circuit board.

9. The Universal Serial Bus electrical connector as claimed in claim 8, wherein the electrical devices are on the other side of the printed circuit board.

10. A connector assembly comprising:

a printed circuit board defining a plurality of connection regions;

an electrical connector seated upon the printed circuit board, the connector comprising:

an insulative housing;

an internal printed circuit board; and a plurality of contacts disposed in the housing and having an amount corresponding to that of the connection regions, one of said contacts being a power contact and directly connecting to said internal printed circuit board;

wherein the remaining of said contacts directly mechanically and electrically connect to the corresponding connection regions, respectively, while said power contact electrically connects to the corresponding connection region via said internal printed circuit board, a protection device mounted on the internal printed circuit board and a conductive clement connected between the internal printed circuit board and said corresponding connection region.

11. The assembly as claimed in claim 10, wherein said connector is a USB connector, and both the amount of said contacts is four arid that of the connection regions are four.

12. The assembly as claimed in claim 10, wherein said internal printed circuit board defines a plane perpendicular to a front-to-back direction of the housing.

13. The assembly as claimed in claim 12, wherein both said power contact and the remaining respectively include mating sections and mounting tails, and the mating section and the mounting tail of the power contact are separated from each other and both mounted to said internal printed circuit board while those of the remaining are integrally formed as one piece.

14. The assembly as claimed in claim 13, wherein there are upper and lower rows of said contacts, and each of said row of the contacts includes one said power contact, under a condition that joints between and internal printed circuit board and the mounting tails of both the power contacts in the upper row and the lower row are located below those between the internal printed circuit board and the mating sections of both the same power contacts in the upper row and the lower row.

15. The assembly as claimed in claim 13, a joint between and internal printed circuit board and the mating section of the power contact is essentially located at a same level with regard to those of the remaining.

16. The assembly as claimed in claim 12, wherein both said power contact and the remaining respectively include mating sections and mounting tails which are all located on an inner side of the internal printed circuit board, and tail ends of said mounting tails of both the power contact and the remaining are essentially aligned with one another along a transverse direction of the housing perpendicular to front-to-back direction.

17. The assembly as claimed in claim 16, wherein the mounting tail of the power contact defines an upside-down L-configuration, under a condition that a horizontal section of said L-configuration is directed rearwardly to connect to the internal printed circuit board.

* * * * *